US007334627B2

(12) United States Patent
Liu et al.

(10) Patent No.: US 7,334,627 B2
(45) Date of Patent: Feb. 26, 2008

(54) ENHANCED HEAT TRANSFER DEVICE WITH ELECTRODES

(75) Inventors: Min-Sheng Liu, Hsinchu (TW); Chi-Chung Wang, Hsinchu (TW); Bing-Chwen Yang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 981 days.

(21) Appl. No.: 10/331,989

(22) Filed: Dec. 31, 2002

(65) Prior Publication Data

US 2004/0112568 A1 Jun. 17, 2004

(51) Int. Cl.

| | |
|---|---|
| ***F28F 13/16*** | (2006.01) |
| ***F28F 13/06*** | (2006.01) |
| ***F28F 13/02*** | (2006.01) |
| ***F28F 13/12*** | (2006.01) |

(52) U.S. Cl. ..... 165/11.1; 165/96; 165/282; 165/295; 165/109.1

(58) Field of Classification Search ..... 165/11.1, 165/96, 295, 282, 109.1

See application file for complete search history.

(56) References Cited

U.S. PATENT DOCUMENTS

| | | | | |
|---|---|---|---|---|
| 4,542,650 | A * | 9/1985 | Renken et al. | 73/196 |
| 5,072,780 | A * | 12/1991 | Yabe | 165/96 |
| 5,965,811 | A * | 10/1999 | Kawai et al. | 73/204.26 |
| 6,206,022 | B1 * | 3/2001 | Tsai et al. | 137/15.18 |
| 6,357,516 | B1 * | 3/2002 | Judge et al. | 165/96 |
| 6,659,172 | B1 * | 12/2003 | Dewar et al. | 165/166 |
| 2003/0022052 | A1 * | 1/2003 | Kearl | 429/34 |
| 2003/0190512 | A1 * | 10/2003 | Takahashi et al. | 429/25 |

FOREIGN PATENT DOCUMENTS

| | | | |
|---|---|---|---|
| JP | 55126792 | A * | 9/1980 |
| JP | 04188024 | A * | 7/1992 |
| JP | 2000277237 | A * | 10/2000 |
| WO | WO 9963293 | A1 * | 12/1999 |

* cited by examiner

*Primary Examiner*—John K. Ford
(74) *Attorney, Agent, or Firm*—Birch, Stewart, Kolasch & Birch, LLP

(57) ABSTRACT

An enhanced heat transfer device with electrodes is provided, which is applied to a heat exchanger with a plurality of fluid channels and includes a plurality of electrodes mounted in the fluid channels of the heat exchanger; a plurality of sensor units mounted in the fluid channels of the heat exchanger for measuring mass flow rates of fluids in the fluid channels; and a power source for providing voltage to the electrodes. The power source is used to drive the electrodes to produce turbulence to fluids passing through the fluid channels according to measured mass flow rates from the sensor units, so as to facilitate uniform fluid flows in the plurality of fluid channels and reduce effect of thermal boundary layer in the fluid channels to thereby enhance heat transfer performance for the heat exchanger.

14 Claims, 6 Drawing Sheets

ENHANCED HEAT TRANSFER DEVICE WITH ELECTRODES

FIELD OF THE INVENTION

The present invention relates to enhanced heat transfer devices with electrodes, and more particularly, to an enhanced heat transfer device with electrodes applied to a micro heat exchanger formed with micro channels.

BACKGROUND OF THE INVENTION

With development and advancement of technology, efficiency and convenience are important orientations in the use of electronic products that are desirably made with low profile, multiple functions and highly efficient operation. In respect of semiconductor industry and integrated circuit (IC) design, although it has successfully attained to important improvements such as profile miniaturization, high integration and multi-functions for electronic elements, however, a reliability issue is generated due to heat production during operation of the electronic elements. In particular, as power-to-work conversion is of a rate not possibly achieving 100%, it means a portion of power is not consumed by operation of the electronic elements but becomes heat that may significantly raise temperature of the entire operating system of electronic elements. If the operating temperature is raised above an upper limit set for safe operation, the system may break down or become failure by virtue of over heat. For advanced new-generation electronic products, internal electronic elements thereof are arranged in higher density and operate at a higher speed than traditional electronic products, thereby producing relatively more heat during operation of the advanced electronic products and easily over raising the operating temperature. For example of a central processing unit (CPU) used in a personal computer (PC) and manufactured by KryoTech Company in U.S.A., a heat production rate of the CPU has increased from 40W of year 1996 to 100W of year 2000; however, a common cooling device having a heat sink and a small fan mounted in association with the CPU can only dissipate 60W of heat. Therefore, higher efficient heat dissipating technology such as fluid cooling or phase variation cooling is greatly required. Moreover, in compliance with low profile electronic elements, associated heat dissipating devices are preferably made with compact size and low weight to be integrated into the electronic elements, which would render a challenge for heat dissipating technology.

A current solution to the foregoing heat dissipating problem is the use of gradually matured MEMS (micro electrical mechanical system) technology that can produce an advanced micro heat dissipating device by relevant semiconductor fabrication processes. As shown in FIG. 5 of a micro heat exchanger 3 with a plurality of micro channels 35, it is formed by subjecting silicon substrates to fabrication processes including film deposition, photo-lithography, wet etching and micro packaging. In particular, the silicon substrates are each etched to form a plurality of parallel micro grooves and then attached to each other to form a plurality of micro channels 35 through which a cooling fluid 5 passes; alternatively, the silicon substrates are stacked to form a heat exchanger with multiple layers of micro channels 35. One surface of the silicon substrate can be mounted with a heat generation source such as IC chip, allowing heat produced from the chip to be directly taken away via the cooling fluid. As the silicon substrate has higher coefficient of heat conduction than a common substrate and similar coefficient of thermal expansion to a silicon chip, it can thereby prevent the chip from being damaged by thermal stress in response to increase in temperature, and also helps enhance heat dissipating efficiency of the micro heat exchanger 3.

However, the above conventional micro heat exchanger 3 still has drawbacks in association with a normal fluid cooling device, that is, the cooling fluid 5 undesirably becomes a source of heat resistance. For the micro channels 35 of the micro heat exchanger 3, the cooling fluid 5 is of a motion with low Reynolds number and may not achieve good heat dissipating effect. In view of a single micro channel 35, due to fluid cohesion, a portion of fluid close to an inner wall of the micro channel 35 may produce a boundary layer 60 with velocity of zero adjacent to the inner wall 35' of the micro channel 35 as shown in FIG. 6; this makes the fluid 5 not flow uniformly in the micro channel 35 in a manner that, mass flow rates at different positions in the micro channel 35 are identical, but flowing and mixing of the fluid 5 are not uniformly formed. Moreover, by heat exchange between the fluid 5 and the inner wall 35', a temperature gradient of the fluid 5 is produced along the inner wall 35' to form a thermal boundary layer that affects heat transfer performance of the heat exchanger 3. Furthermore, besides effect of boundary layer in each of the micro channels 35, non-uniform fluid flows in different micro channels 35 would lead to reduction in thermal transmission. In view of a formula for mass flow rate:

$$\text{mass flow rate}=\rho\times A\times v$$

wherein ρ, A, v respectively represent fluid density, cross-sectional area and velocity, for different micro channels 35 located on the same plane, different velocitys v and fluid densities ρ in the micro channels 35 lead to different mass flow rates of fluids 5 in different channels 35. Therefore, as shown in FIGS. 7A, 7B and 7C, it may be the case that central channels 35*a* or side channels 35*b* have relatively higher mass flow rates, or mass flow rates in different channels 35 are not regularly distributed, depending on channel size and resistance, location of the heat exchanger, fluid velocity, fluid type, temperature, etc. This irregular distribution of mass flow rates would undesirably reduce heat transfer performance and heat dissipating efficiency of the heat exchanger.

Therefore, the problem to be solved herein is to provide an enhanced heat transfer device, which can measure a mass flow rate of fluid in each micro channel and facilitate uniform fluid flows in different channels in a manner as to minimize effect of thermal boundary layer of fluid in each channel and to improve heat transfer performance of a micro heat exchanger.

SUMMARY OF THE INVENTION

An objective of the present invention is to provide an enhanced heat transfer device with electrodes, which allows uniform fluid flows in different fluid channels.

Another objective of the invention is to provide an enhanced heat transfer device with electrodes, which can minimize effect of thermal boundary layer of fluids in fluid channels.

A further objective of the invention is to provide an enhanced heat transfer device with electrodes, which can measure a mass flow rate of fluid in each fluid channel.

In accordance with the above and other objectives, the present invention proposes an enhanced heat transfer device with electrodes, comprising: a plurality of electrodes mounted in a plurality of fluid channels of a heat exchanger; a plurality of sensor units mounted in the fluid channels of the heat exchanger for measuring mass flow rates of fluids in the fluid channels; and a power source for providing voltage to the electrodes for driving the electrodes to produce turbulence to the fluids passing through the fluid channels according to measured mass flow rates from the sensor units.

The plurality of electrodes and sensor units are integrally formed with the plurality of fluid channels. The sensor units can be sensors used for measuring mass flow rates of fluids, temperatures or pressures in the fluid channels, wherein electrohydrodynamic (EHD) theory is applied for allowing the power source to drive the electrodes to produce turbulence according to measured mass flow rates of fluids in the fluid channels, so as to minimize effect of thermal boundary layer in the fluid channels and facilitate uniform mixing of fluids. Further, air bubbles or voids would be formed by turbulence in fluid channels having relatively greater mass flow rates of fluids to thereby increase flow resistance, whereby fluids not entering into the fluid channels may change flow directions thereof so as to facilitate uniform fluid flows in the fluid channels and improve heat transfer performance of the heat exchanger. The enhanced heat transfer device is suitably applied to a heat exchange system using liquids, gases, two-phase liquid/gas saturated fluids as cooling fluids; besides improving heat transfer performance, the enhanced heat transfer device can also measure mass flow rates of fluids in the fluid channels and operate with considerably low power consumption, which thereby desirably solves problems encountered in the use of conventional devices.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
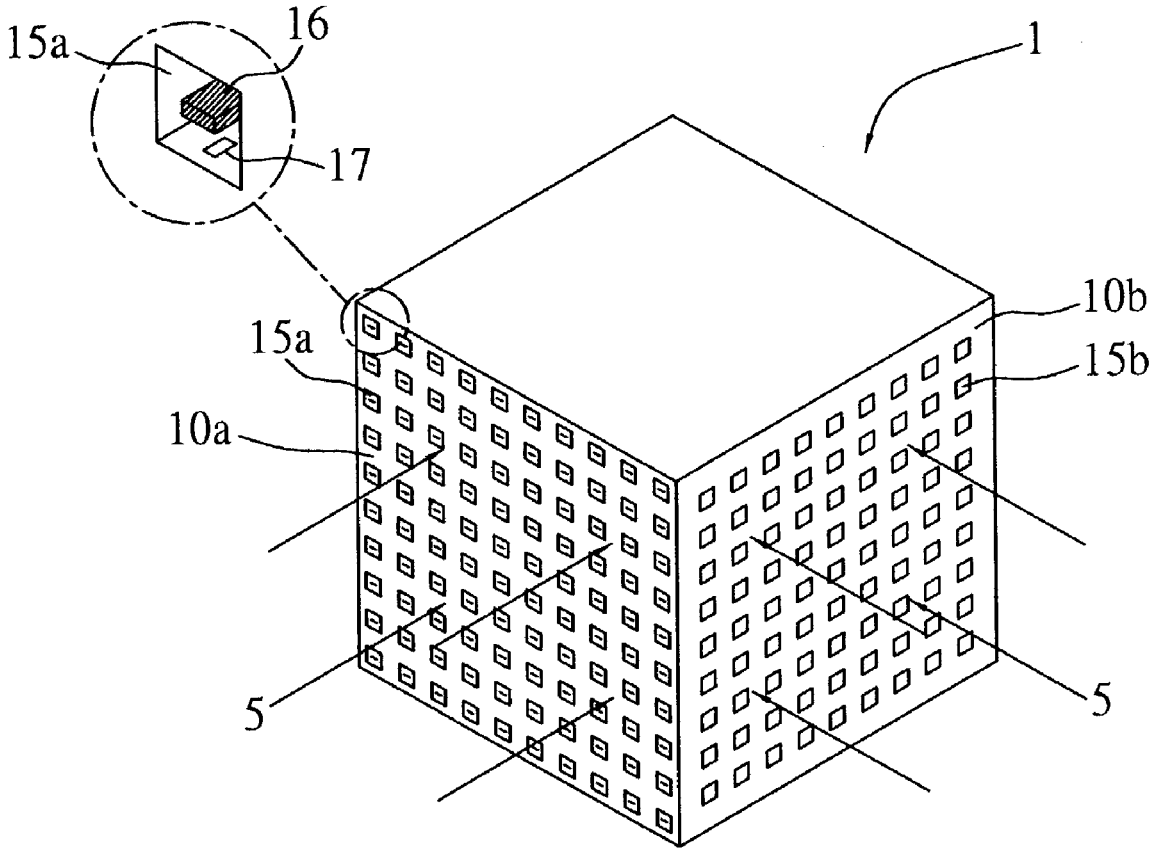
FIG. 1 is a perspective view of an enhanced heat transfer device with electrodes according to a preferred embodiment of the invention.

The present invention applies electrohydrodynamic (EHD) theory to a heat dissipating system in which electrodes are mounted in fluid channels where fluids pass, and connected to an external power source that generates a high-voltage and low-current electric field to produce turbulence to boundary layers of fluids in the fluid channels and allow uniform fluid flows in the fluid channels so as to improve heat transfer performance. FIG. 1 illustrates an enhanced heat transfer device with electrodes according to a preferred embodiment of the invention, which is applied to a micro heat exchanger 1 made of stainless steel. A first conductive surface 10*a* of the micro heat exchanger 1 is formed with one hundred of micro channels 15*a* arranged in a 10×10 array and penetrating through the micro heat exchanger 1, allowing cooling fluids 5 to pass through the micro channels 15*a* for heat exchange, wherein each micro channel 15*a* has a diameter of about 100 μm. Similarly, a second conductive surface 10*b* vertically positioned to the first conductive surface 10*a* is formed with a plurality of micro channels 15*b* arranged in a 9×9 array (81 in number) so as to enhance efficiency of heat exchange. These micro channels 15*b* are staggered in position and orientation with respect to the micro channels 15*a* on the first conductive surface 10*a*, such that the total 181 micro channels 15*a* and 15*b* are not interconnected, and thus cooling fluids 5 for heat exchange in the micro channels 15*a* and 15*b* would not mix with each other. It should be understood that, the arrangement and number of the micro channels 15*a* and 15*b*, not limited to the above description, can flexibly depend on practical requirements of heat transfer for a corresponding heat dissipating system.

Figures 7A, 7B, 7C:
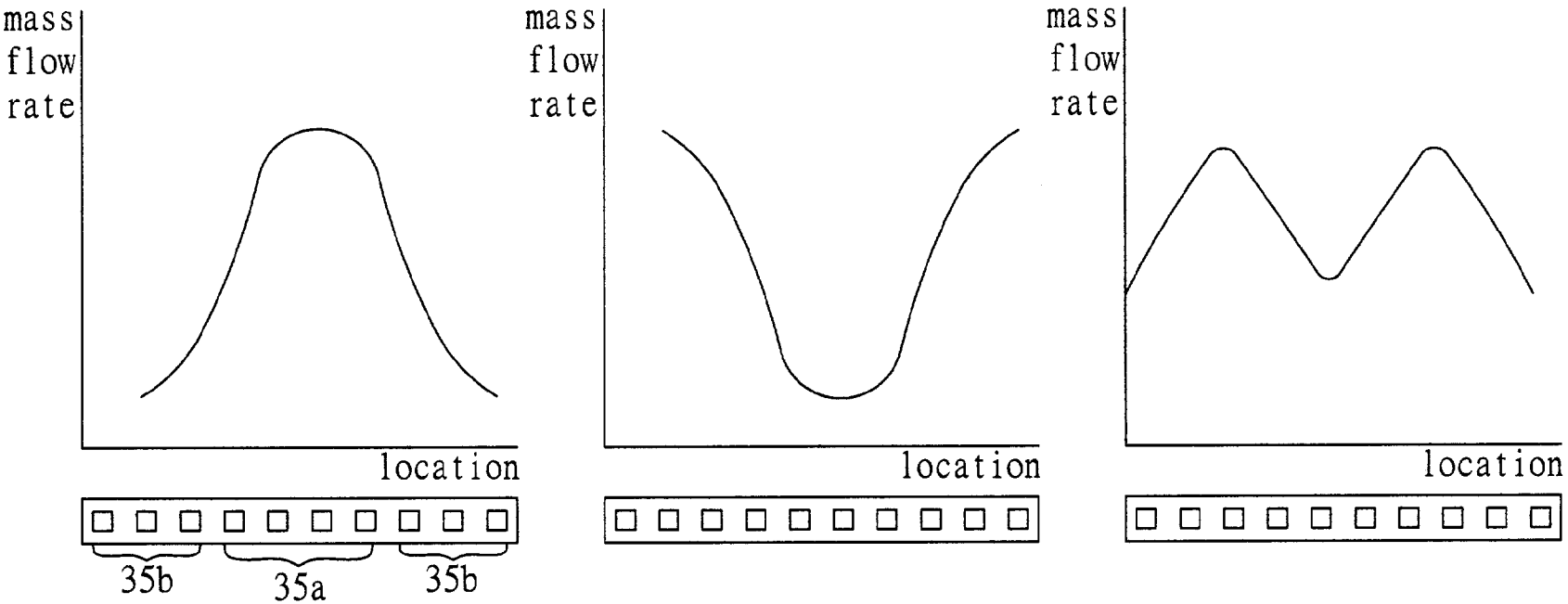
FIG. 7A (PRIOR ART)
FIG. 7B (PRIOR ART)
FIG. 7C (PRIOR ART)
FIGS. 7A-7C (PRIOR ART) are schematic diagrams of mass flow rates of fluids in micro channels of the conventional micro heat exchanger.

The enhanced heat transfer device of this embodiment, as shown in FIG. 1, is formed with a metal electrode 16 in each of the micro channels 15*a* on the first conductive surface 10*a*, wherein the metal electrode 16 has a height about between 0.3 to 10 μm and a width between 2 to 50 μm and is arranged in a direction parallel to the corresponding micro channel 15*a* in a manner that the electrode 16 is positioned at the center of the micro channel 15*a* from a cross-sectional view and has its cathode being grounded. The electrodes 16 are connected to an external power source (not shown) that provides positive voltage to the electrodes 16 for producing turbulence to fluids 5 passing through the micro channels 15*a*. Moreover, in order to prevent electricity leakage of the metal electrodes 16 after being electrically conducted, a portion of each electrode 16 mounted to the corresponding micro channel 15*a* is made of an insulating material, and the cooling fluid 5 used herein can be a poor conductive fluid having a dielectric constant between 2 to 100 such as deionized water. The cooling fluid 5 is not limited to a liquid, but may also be a gas or a mixture of liquid and gas. Besides the electrodes 16 and power source, each of the micro channels 15*a* on the first conductive surface 10*a* can further be provided with a sensor unit 17 for sensing and measuring a mass flow rate of fluid 5 in each micro channel 15*a*. Although mass flow rates of fluids 5 in different micro channels 15*a* may not be identical (as shown in FIGS. 7A, 7B and 7C), in a steady state, different positions in a single micro channel 15*a* have the same mass flow rate of fluid. In consideration of fabrication costs, each micro channel 15*a* can be provided with only one sensor unit 17 at a position not interfering with flowing of fluid 5. Further, for precise measurement and data analysis of fluid flow, each micro channel 15*a* may be formed with a plurality of sensor units 17, and measured results from the sensor units 17 are averaged to obtain a precise mass flow rate of fluid 5. In FIG. 1 of this embodiment, the electrodes 16 and sensor units 17 are merely illustratively mounted to the micro channels 15*a* formed on the first conductive surface 10*a*; for the micro channels 15*b* on the second conductive surface 10*b*, electrodes and/or sensor units may be or may not be provided in the micro channels 15*b* in concern of fabrication costs and enhancement in heat transfer.

Figure 2:
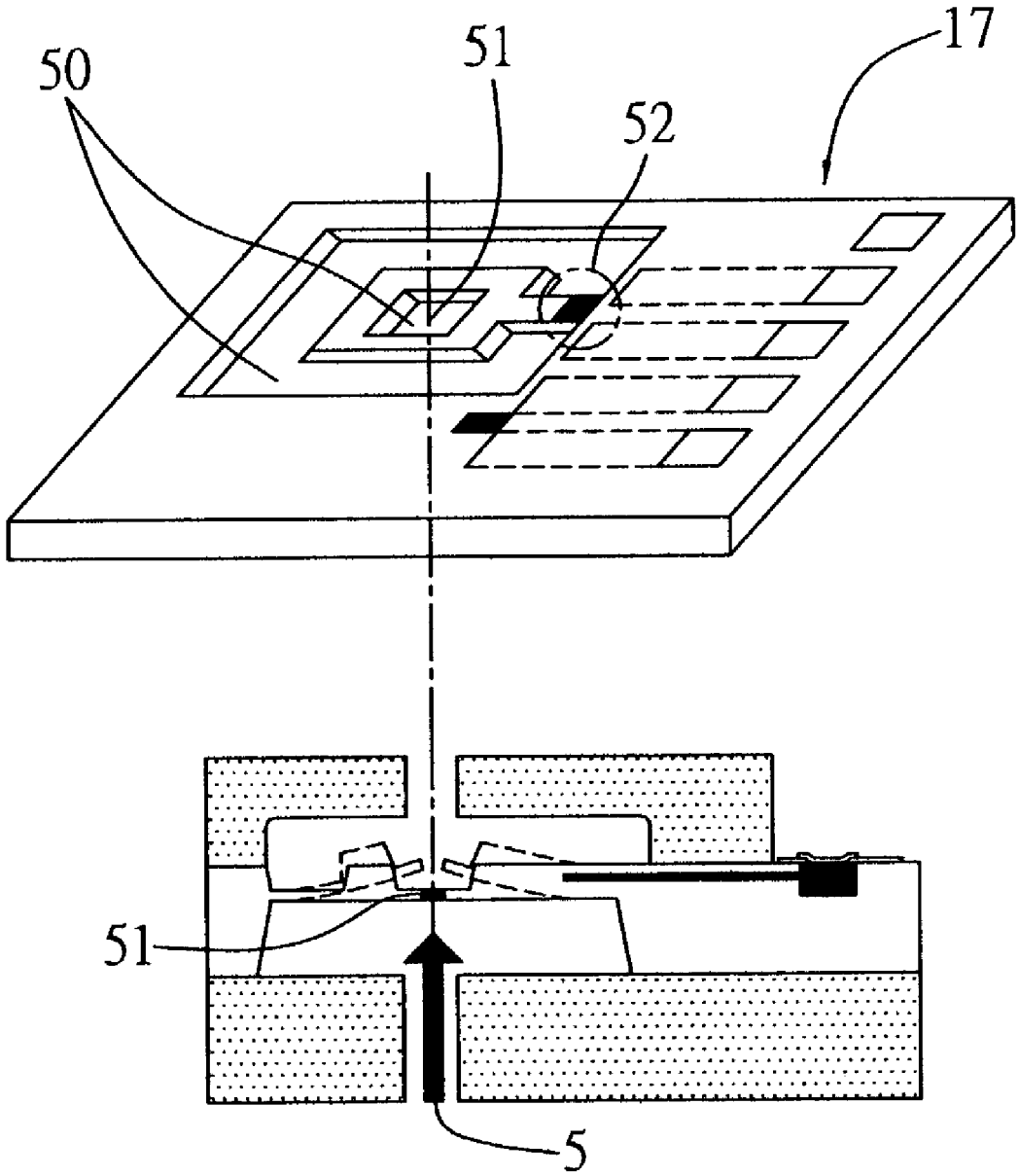
FIG. 2 is a schematic diagram of a micro sensor according to a preferred embodiment of the invention.

In compliance with low profile of the micro heat exchanger 1, the sensor unit 17 provided in each micro channel 15*a*, 15*b* can be a micro sensor fabricated by MEM (micro electrical mechanical) technology to be capable of directly or indirectly measuring a mass flow rate of fluid in the micro channel 15*a*, 15*b*; for example, the micro sensor applied in this embodiment may operate in a conventional manner of differential pressure, thermal time-of-flight or thermo-transfer for measurement. As shown in FIG. 2, in exemplification of a differential-pressure sensor unit 17, it utilizes a piezoelectric material and a thin film 50 to convert a measured value of fluid pressure to a voltage signal for determining mass flow rates of fluids in different micro channels. The measuring mechanism involves that in a condition of low Reynolds number and multiple layered fluid flows, a pressure difference is positively proportional to a mass flow rate of fluid around an orifice 51, and thus, a pressure resistance sensor 52 embedded by an ion implantation technique can be used to measure a fluid pressure that is converted to a mass flow rate of fluid passing through the orifice 51. Alternatively, a piezoelectric thin film can be fabricated to directly or indirectly measure the mass flow rate of fluid in the micro channel, and has advantages of conversion between mechanical and electrical energy, high power density and low environmental sensitivity. Besides the pressure resistance sensor, the above conventional thermal time-of-flight and thermo-transfer sensors for measuring and converting a fluid temperature to a mass flow rate of fluid, or general thermocouple temperature and pressure sensors, can all be applied to the micro heat exchanger 1 for measuring mass flow rates of fluids in micro channels 15*a*, 15*b* and selected depending on costs and a fluid system in use. For example, if a fluid used is a gas, a thermo-transfer sensor with relatively higher sensitivity is preferred and capable of measuring a mass flow rate as small as 0.1 μL/min.

Figure 3:
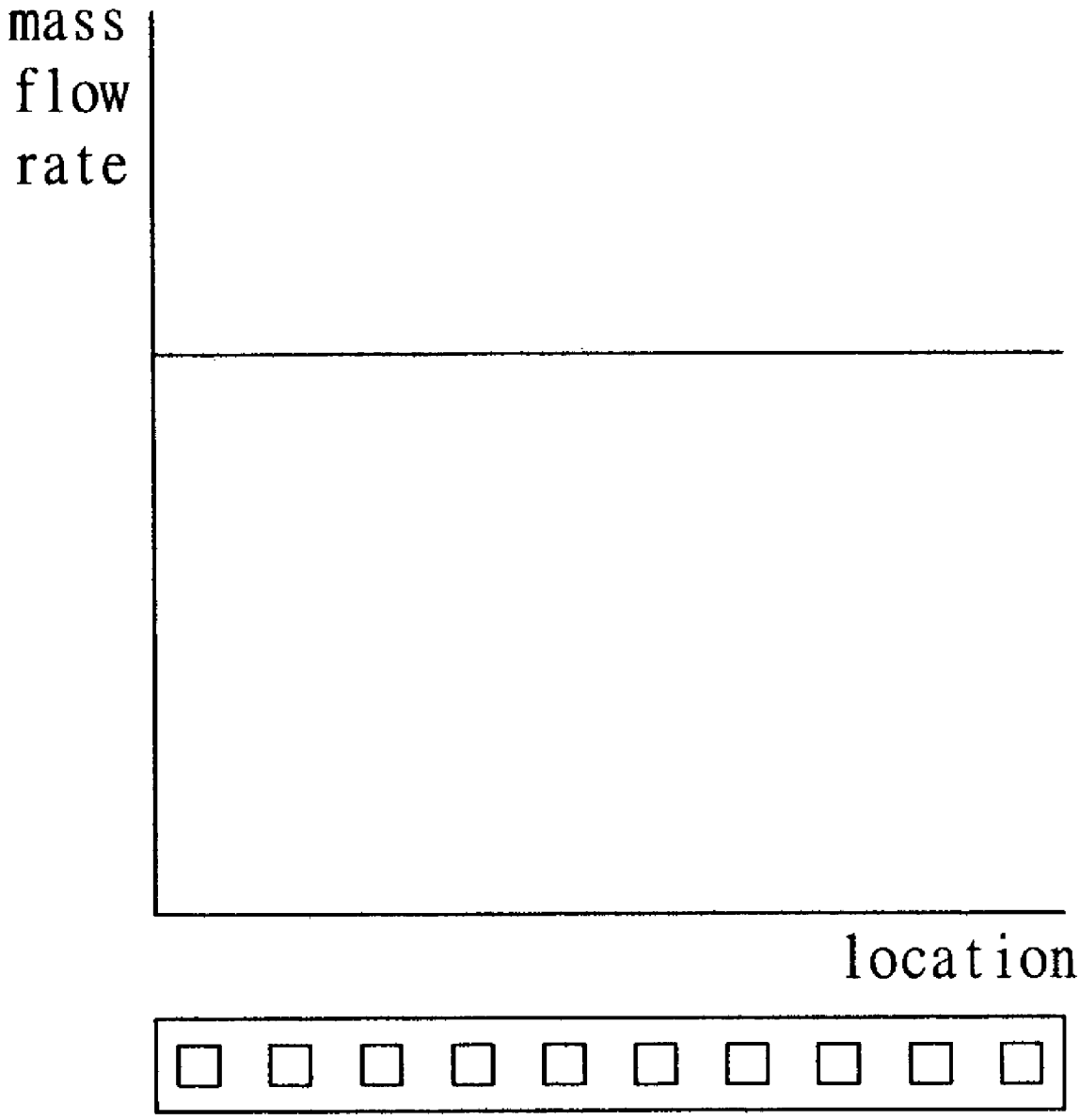
FIG. 3 is a schematic diagram of mass flow rates of fluids in fluid channels of the enhanced heat transfer device shown in FIG. 1.

When a heat generator (such as a central processing unit of computer) produces heat taken away by a cooling fluid 5, the heated cooling fluid 5 flows through the conductive surface 10*a*, 10*b* into the plurality of micro channels 15*a*, 15*b*. According to size of the micro channels 15*a*, 15*b*, location of the heat exchanger 1, type of the fluid 5, velocity and temperature, the micro channels 15*a*, 15*b* have different mass flow rates of fluids as shown in FIGS. 7A, 7B and 7C, and the sensor unit 17 installed in each of the micro channels 15*a*, 15*b* measures and converts a mass flow rate of fluid depending on fluid physical properties (such as fluid flow, temperature, pressure, etc.) to an electric signal, whereby an external power source provides positive voltage to the electrode 16 corresponding to the electric signal in a manner that, an electrode in a micro channel having a relatively larger mass flow rate of fluid produces greater turbulence, and an electrode in a micro channel having a relatively smaller mass flow rate of fluid produces less turbulence, so as to minimize a boundary layer of a heat-transmission surface by turbulence and to increase fluid mixing and improve heat transfer performance. Furthermore, with greater turbulence being produced in a micro channel having a relatively larger mass flow rate of fluid, air bubbles or voids are easily formed in the flow field and may lead to increase in resistance of the flow field in the micro channel, making the external fluid 5 not easily enter into the micro channel, which thereby facilitates uniform fluid flows in different micro channels. In exemplification of a conventional diagram of mass flow rates shown in FIG. 7A, turbulence produced from the electrodes 16 increases resistance of central channels 35*a*, making relatively more fluids enter into side channels 35*b* in which mass flow rates of fluids are enhanced for facilitating uniform fluid flows in different channels as shown in FIG. 3. Similarly, for example of conventional diagrams of mass flow rates shown in FIGS. 7B and 7C, turbulence from electrodes can also facilitate uniform fluid flows in different channels as shown in FIG. 3, thereby effectively improving heat dissipating efficiency and heat transfer performance of the micro heat exchanger.

Figure 4:
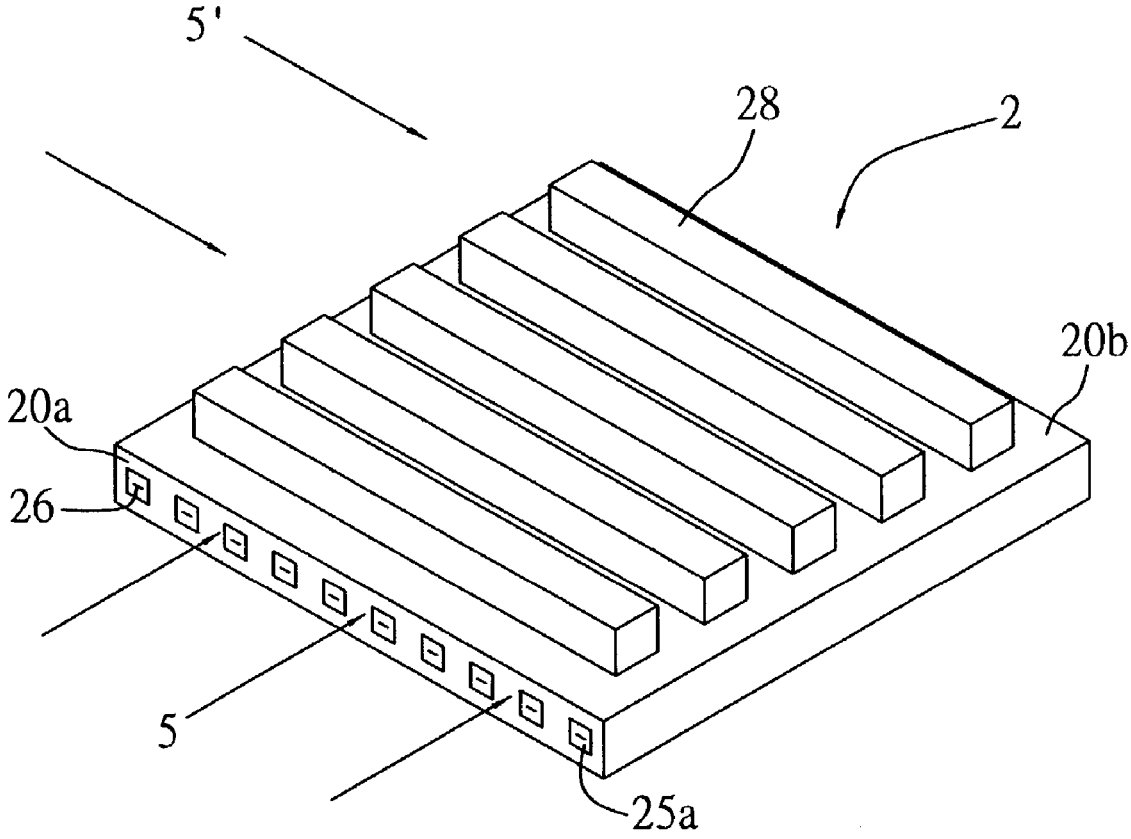
FIG. 4 is a perspective view of the enhanced heat transfer device with electrodes according to another preferred embodiment of the invention.
Figure 5:
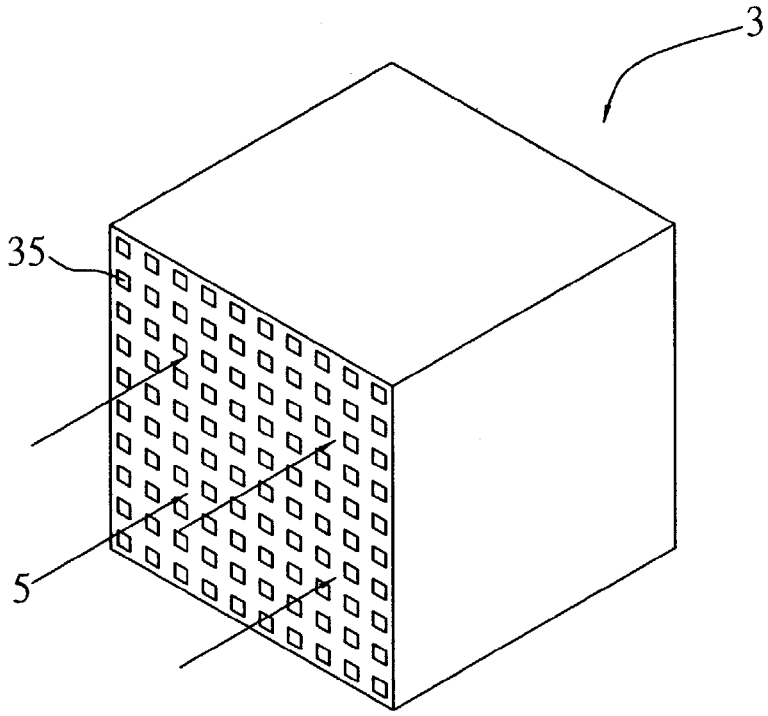
FIG. 5 (PRIOR ART)
FIG. 5 (PRIOR ART) is a perspective view of a conventional micro heat exchanger.
Figure 6:
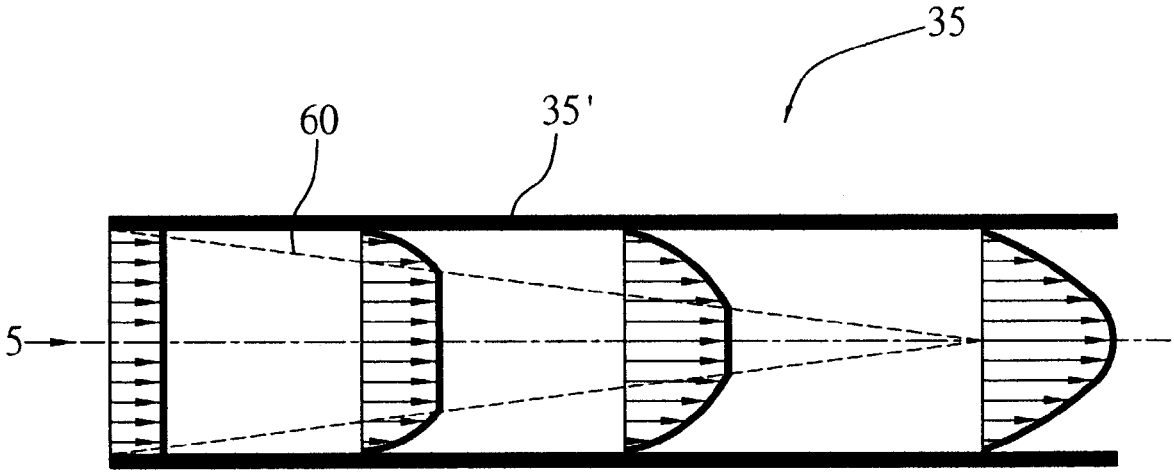
FIG. 6 (PRIOR ART)
FIG. 6 (PRIOR ART) is a schematic diagram showing boundary layer effect of a fluid in a micro channel.

In another preferred embodiment of the invention, the enhanced heat transfer device is also suitably applied to a conventional micro heat exchanger 2 shown in FIG. 4. A first conductive surface 20*a* of the heat exchanger 2 is formed with ten micro channels 25*a* that are arranged parallel to each other and penetrate through the heat exchanger 2. A second conductive surface 20*b* of the heat exchanger 2 is vertically adjacent to the first conductive surface 20*a*, and formed with five parallel metal heat fins 28 for use in gas cooling. Gases 5' passing through the metal fins 28 would mix with each other on the second conductive surface 20*b* during a heat exchange process to form a mixed stream. Electrodes 26 and sensor units (not shown) are mounted in the micro channels 25*a* of the first conductive surface 20*a* respectively, wherein the electrodes 26 are externally connected to a power source, as similarly structured to the enhanced heat transfer device according the above described preferred embodiment, such that the electrodes 26 are adapted to produce turbulence according to mass flow rates of fluids measured by the sensor units, to thereby eliminate non-uniform fluid flows and eliminate the thermal boundary layer and to improve heat transfer performance in the micro channels 25*a* of the first conductive surface 20*a* of the heat exchanger 2.

Therefore, the EHD theory can be applied in this invention for facilitating uniform flows of cooling fluids in a heat exchanger and minimizing effect of thermal boundary layer in a flow field to mix up the fluids so as to enhance heat transfer performance. Moreover, the enhanced heat transfer device according to the invention gives similar improvements to flow fields of single phase liquids or gases, and more preferable improvements with respect to a two-phase evaporation condensation flow field of coexisting saturated liquid and gas. Due to considerably non-uniform fluid flows in the two-phase flow field, the use of the enhanced heat transfer device may increase coefficient of thermal transmission. Furthermore, when the enhanced heat transfer device is used in a micro fluid system such as a micro heat exchanger in the above embodiments, voltage applied to the system is merely about several decades of volts without significantly increasing power consumption.

In conclusion, the enhanced heat transfer device with electrodes according to the invention can effectively reduce effect of thermal boundary layer in fluid channels, and facilitate uniform fluid flows in the fluid channels, as well as precisely measure mass flow rates of fluids in the fluid channels, so as to improve heat transfer performance of the entire system without having to consume a significant amount of power.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An enhanced heat transfer device with electrodes, applied to a heat exchanger formed with a plurality of fluid channels, comprising:

a plurality of electrodes mounted in the fluid channels of the heat exchanger, allowing each of the fluid channels to be provided with at least one of the electrodes;

a plurality of sensor units mounted in the fluid channels of the heat exchanger for measuring mass flow rates of fluids in the fluid channels, allowing each of the fluid channels to be provided with at least one of the sensor units; and a power source for providing voltage to the electrodes for driving the electrodes to produce turbulence to fluids passing through the fluid channels according to measured mass flow rates from the sensor units.

2. The enhanced heat transfer device with electrodes of claim 1, wherein the plurality of fluid channels are micro channels in a micro heat exchanger.

3. The enhanced heat transfer device with electrodes of claim 1, wherein the plurality of electrodes and sensor units are integrally formed with the corresponding plurality of fluid channels.

4. The enhanced heat transfer device with electrodes of claim 1, wherein the plurality of electrodes are respectively provided with different amounts of voltage from the power source according to measured mass flow rates of fluids in the fluid channels in a manner that an electrode in a fluid channel having a relatively larger mass flow rate of fluid produces greater turbulence, and an electrode in a fluid channel having a relatively smaller mass flow rate of fluid produces less turbulence.

5. The enhanced heat transfer device with electrodes of claim 1, wherein the power source provides voltage to part of the electrodes mounted in the fluid channels having relatively larger mass flow rates of fluids, so as to drive the electrodes to produce turbulence in the corresponding fluid channels.

6. The enhanced heat transfer device with electrodes of claim 1, wherein the sensor unit is a flow meter for measuring the mass flow rate of fluid in each of the fluid channels.

7. The enhanced heat transfer device with electrodes of claim 1, wherein the sensor unit is a thermometer for measuring a fluid temperature in each of the fluid channels.

8. The enhanced heat transfer device with electrodes of claim 1, wherein the sensor unit is a pressure sensor for measuring a fluid pressure in each of the fluid channels.

9. The enhanced heat transfer device with electrodes of claim 1, wherein the electrodes are mounted in a direction parallel to the corresponding fluid channels.

10. The enhanced heat transfer device with electrodes of claim 9, wherein a portion of each of the electrodes mounted to the corresponding fluid channel is made of an insulating material.

11. The enhanced heat transfer device with electrodes of claim 9, wherein cathodes of the electrodes are ground terminals.

12. The enhanced heat transfer device with electrodes of claim 1, wherein the plurality of fluid channels are not interconnected, allowing the fluids passing therethrough not to mix with each other.

13. The enhanced heat transfer device with electrodes of claim 12, wherein the plurality of fluid channels are parallel to each other.

14. The enhanced heat transfer device with electrodes of claim 1, wherein the fluid is selected from the group consisting of liquid, gas and a mixture thereof.

* * * * *